United States Patent [19]

Esposto

[11] 4,108,186

[45] Aug. 22, 1978

[54] COMB FOR SUBDIVIDING HAIR STRANDS

[75] Inventor: Victor Esposto, Pittsburgh, Pa.

[73] Assignee: Frost Enterprises, Inc., Pittsburgh, Pa.

[21] Appl. No.: 726,563

[22] Filed: Sep. 27, 1976

[51] Int. Cl.[2] ..... A45D 24/00

[52] U.S. Cl. ..... 132/124; 132/11 R

[58] Field of Search ..... 132/11 R, 161, 48 A, 132/48 R, 137, 9, 124, 127, 144, 111 R

[56] References Cited

U.S. PATENT DOCUMENTS

| | | | |
|---|---|---|---|
| 672,159 | 4/1901 | Bechtold | 132/48 R |
| 1,621,425 | 3/1927 | Meek | 132/124 X |
| 2,384,152 | 9/1945 | Black | 132/161 |
| 2,649,763 | 8/1953 | Buergi-Schenk | 132/144 |
| 3,394,714 | 7/1968 | Kirwan | 132/11 R |

FOREIGN PATENT DOCUMENTS

| | | | |
|---|---|---|---|
| 1,263,982 | 5/1961 | France | 132/161 |

*Primary Examiner*—Louis G. Mancene

*Attorney, Agent, or Firm*—Carothers and Carothers

[57] ABSTRACT

A styling comb having teeth of different root depths such that the depth of the root space between adjacent teeth alternately varies between shallow and deep thereby forming a natural separation of the strands of hair as the comb is drawn through hair on a subject's head. A slide slides along a base or handle of the comb such that it may be slid by thumb contact of the same hand in which the operator grasps the comb. A finger is secured to the slide and designed such that it extends longitudinally along a side face of the comb between the shallow and deep root spaces between comb teeth such that the finger will segregate hair strands lying in the deep root spaces of the comb when the slide member is slid into position.

2 Claims, 3 Drawing Figures

COMB FOR SUBDIVIDING HAIR STRANDS

BACKGROUND OF THE INVENTION

1. Field of Invention

This invention relates generally to combs and more particularly to combs for uniformly separating or subdividing hair strands in order to treat only selected strands of hair.

2. Discussion of the Prior Art

In treating human hair for coloring effects, it is desirable in many instances to dye or treat a uniform dispersion of the hair strands or tufts throughout the entire body of hair. This technique is generally employed, for example, for a hair coloring process known as frosting.

One apparatus utilized to uniformly subdivide strands or tufts of hair is a comb which has adjacent teeth of different root depths thereby uniformly subdividing the hair strands or tufts in the deep and shallow root portions of the comb. This type of apparatus and process is illustrated in U.S. Pat. No. 3,952,755 which issued to Karol C. Fisher on Apr. 27, 1976.

When the comb of this structure is drawn through the subject's hair such that the hair strands or tufts are uniformly subdivided into the comb teeth deep root and shallow root spaces, a wire is slid into a recess which extends longitudinally along a side face of the comb between the shallow and deep roots to complete the subdivision.

This comb of prior art is effective, but nevertheless, has shortcomings in that it takes two hands to operate the comb i.e., one hand to hold the comb and the other hand to manipulate the slide wire, and if the slide wire is not sufficiently straight, it can be readily seen that the end of the slide wire will not properly align with and mate the recess in which it is received when the end of the wire advances through this segmented recess from one tooth to the next.

It is the principal object of the present invention to eliminate these disadvantages of the comb structure disclosed in U.S. Pat. No. 3,952,755.

SUMMARY OF THE INVENTION

The comb for separating or subdividing hair strands of the present invention comprises an elongated comb root base having a series of parallel comb teeth extending off one edge of the base and the depth of the root space between adjacent teeth as measured from the top of the teeth alternately varies between shallow and deep. A slide member is slidably secured to the root base such that it will slide longitudinally therealong. A finger attached to this slide member, longitudinally extends along one side face of the comb between the shallow and deep root spaces to segregate the hair strands lying in the deep root spaces upon manipulation of the slide member by the comb operator.

In this manner, the difficulty of attempting to slide a wire through a segmented recess from one tooth to another is eliminated, and in addition, one operating the comb of the present invention can operate the slide member at the same time and with the same hand in which he is grasping the comb. In addition, the slide member is preferably exposed on opposite sides of the root base of the comb so that the slide member may be operated by one who is left handed as well as one who is right handed.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DETAILED DESCRIPTION OF THE DRAWINGS

Figure 1:
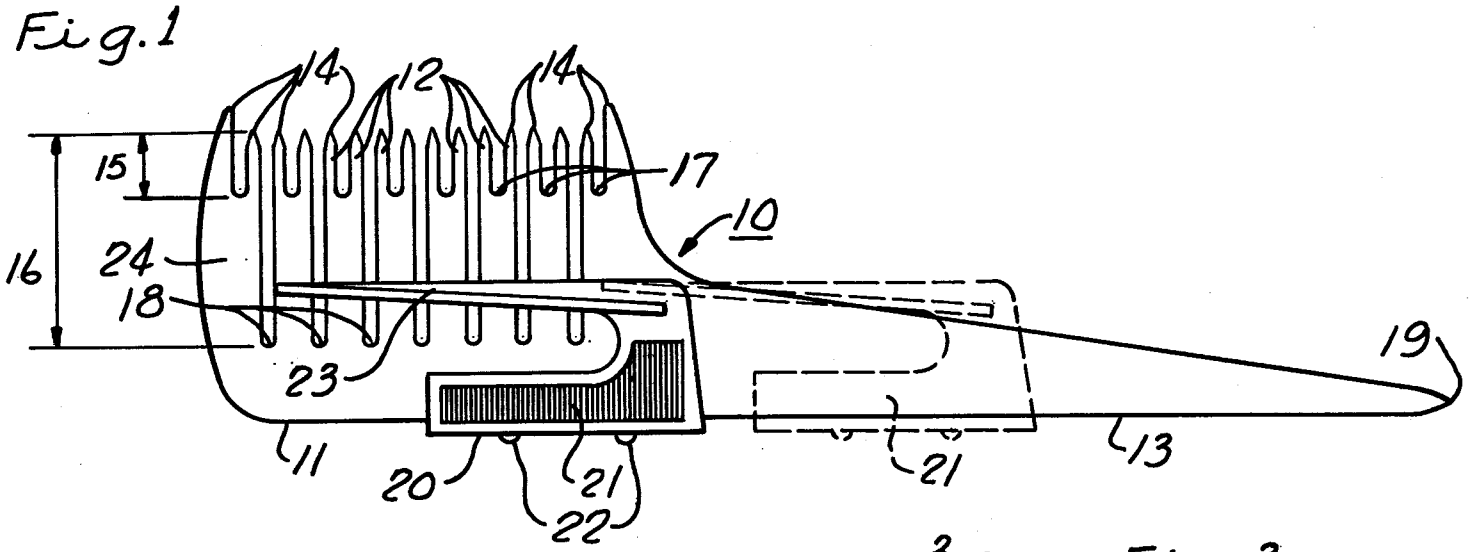
FIG. 1 is a view in side elevation of the comb of the present invention.

Referring to the drawings, the comb 10 of the present invention consists first of all of the basic comb elements, namely, the comb root base 11, the series of parallel comb teeth 12 which extend off one edge of the comb root base 11 and handle 13 (which basically an extension of comb root base 11). The root spaces between adjacent teeth 12 vary in depth as measured from the tops 14 alternately from a shallow depth 15 to a deep depth 16. The shallow root spaces between adjacent teeth 12 are designated 17, and the deep root spaces between adjacent teeth are designated 18.

Handle 13 is designed such that it is long and narrow and terminates at a point 19. This serves two purposes. First of all, the elongated narrow handle 13 serves as a typical "rat tail" comb wherein the handle of the comb itself is easily utilized as a working tool to pick up or select strands or tufts of hair as any rat tail comb might be normally utilized. In addition, the construction of handle 13 provides a handle which is sufficiently long such that the hairdresser may grip the outer end of the handle 13 and still have sufficient handle length remaining to operate slide member 20 longitudinally back and forth along comb root base 11 with same hand that grasps the comb, as will be explained in greater detail hereinafter.

Slide member 20 is an independent piece which is slidably secured to root base 11 so that it will slide longitudinally therealong by finger engagement (usually the thumb). Slide member 20 is maintained in this sliding relationship with root base 11 by reason of protrusion 26 of the slide member which is received in slide groove 25 in the side of base 11.

In the Figure, slide member 20 is indicated in its full forward position, and the dashed outline thereof indicates the position of slide member 20 in its retracted position.

Figure 2:
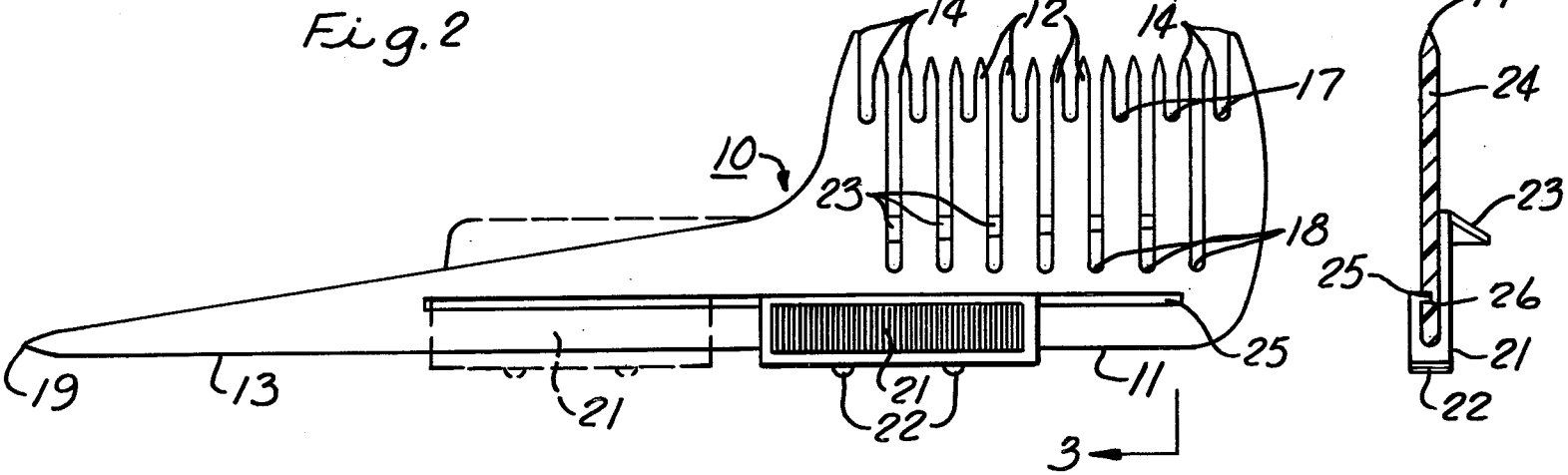
FIG. 2 is a view in side elevation showing the back side of the comb in FIG. 1.
Figure 3:
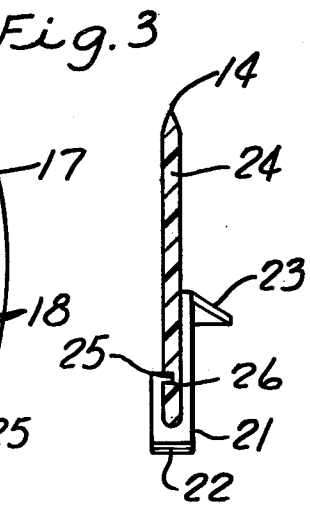
FIG. 3 is an end view of the comb shown in FIG. 1 as seen from the right-hand end thereof.

Slide member 20 has a U-shaped configuration (as best illustrated in FIG. 3), which accordingly exposes portions of the slide member on opposite sides of the root base 11. This permits finger engagement of slide member 20 on either side of the comb 10 so that it may be readily utilized by either left-handed or right-handed persons. FIG. 1 illustrates the comb in the position that it would be grasped by the right-handed person, and FIG. 2 illustrates the back side of the same comb as it would be seen and grasped by a left-handed person. Both sides of the slide member 20 are provided with roughened surface areas 21 to prevent slippage when engaged by one's thumb or finger in order to slide member 20 longitudinally back and forth along the comb root base 11. The bottom of slide member 20 is also provided with projections 22 for the same reason.

Finger 23 extends from slide member 20 and further extends longitudinally along one side face 24 of the comb 10 between the shallow root spaces 17 and the deep root spaces 18. In this regard, it should be observed that when slide member 20 is in its retracted position as indicated by the dashed lead line and outline thereof, the deep root tooth spaces 18 are totally open, as any normal comb would be, to permit strands of hair being combed to fall all the way through the deep root tooth spacings to the bottom thereof as indicated at 18. When slide member 20 is slid to the forward position as shown in the figures, finger 23 slides across side face 24 of the comb to isolate or segregate any hair strands which are lying in the deep root spaces 18.

The comb is utilized by the hair stylist or beautician by making upward strokes through the hair so that the comb is held in the position as indicated in the drawings. With the same hand with which the beautician grasps the handle 13, he slides slide member 20 longitudinally to the retracted position as indicated by the dashed outline, usually making use of his thumb.

He then makes an upward stroke through the subject's hair. Due to the tooth configuration as previously explained, the combination of shallow and deep root teeth creates a natural subdivision or segregation of hair strands or tufts in a uniform manner such that a number of hair strands lie on shallow tooth root spaces 17 and a generally proportionate number of hair strands lie on deep root spaces 18. At this point, the beautician then slides slide member 20 forward to its closed position as indicated in the figures, thereby completing the subdivision or separation operation such that the hair strands lying in deep root spaces 18 are completely segregated.

In this regard, it should be noted that finger 23 is wedge shaped and thickens towards its rearward extent. This causes the finger 23 to have a wedging action on the hair strands confined within deep root spaces 18 so that once slide member 20 is placed in its forward position as indicated, finger 23 tends to clamp down on the hair strands trapped therein. The result is that the beautician at this point in time may release the comb entirely and the wedging action of finger member 23 against the hair strands will hold the comb in place on the subject's head in and of itself.

The beautician then has both hands free to pick up and work with those hair strands or tufts which lie in the shallow root spaces 17 to work with them as required. For example, the beautician will normally utilize other equipment to bleach or frost or otherwise color these selected strands of hair lying in the shallow root spaces 17. The comb is simply convenient tool to uniformly subdivide the hair strands so that only a uniform dispersion of the hair strands may be readily treated.

For a more detailed description of the hair treating techniques which might thereafter follow, one should refer to U.S. Pat. No. 3,952,755 or U.S. Pat. No. 3,800,811.

I claim:

1. A comb for subdividing hair strands comprising an elongated comb root base having a series of parallel comb teeth extending off one edge thereof with the depth of the root space between adjacent teeth from the teeth tops alternately varying between shallow and deep, a slide member slidably secured to said root base to slide longitudinally therealong, a finger extending from said slide member and longitudinally along a side face of the comb between said shallow and deep root spaces to segregate hair strands lying in said deep root spaces at will by sliding said slide member along said root base.

2. The comb of claim 1 including a comb handle extending from one end to said root base, said slide member having portions thereof exposed on opposite sides of said root base for slide contact on either side of the comb.

* * * * *